US005224700A

United States Patent [19]

Rosen

[11] Patent Number: 5,224,700

[45] Date of Patent: Jul. 6, 1993

[54] COMBINED PUTTING GREEN REPAIR TOOL AND STOPWATCH

[76] Inventor: Carl-Erik M. Rosen, Box 197, S-523 24 Ulricehamn, Sweden

[21] Appl. No.: 885,482

[22] Filed: May 19, 1992

[51] Int. Cl.[5] ..... A63B 57/00; G04B 47/00

[52] U.S. Cl. ..... 273/32 B; 172/438; 172/378; 368/10; 368/101; 368/110; 224/152

[58] Field of Search ..... D10/31; 368/10, 43, 368/278, 101, 110, 55 B; D21/234; 273/32 R, 32 H, 32 B; 172/378, 438; 224/152

[56] References Cited

U.S. PATENT DOCUMENTS

| | | | |
|---|---|---|---|
| D. 61,220 | 7/1922 | Ochse | D10/31 X |
| 318,625 | 7/1991 | Stowell | D10/31 |
| 3,648,454 | 3/1972 | Morrison | 368/101 X |
| 4,354,260 | 10/1982 | Planzo | 368/43 X |
| 4,731,766 | 3/1988 | Bunyea | 368/110 X |
| 4,998,727 | 3/1991 | Person | 273/55 B X |
| 5,088,072 | 2/1992 | Fitzmorris | 368/110 X |
| 5,121,367 | 6/1992 | Rose | 368/110 X |
| 5,160,134 | 11/1992 | McDonald | 273/32 B |

*Primary Examiner*—George J. Marlo
*Attorney, Agent, or Firm*—Poms, Smith, Lande & Rose

[57] ABSTRACT

A pitch-mark repair tool used for repairing pitch-marks made on greens when playing golf is provided with a timing device which allows specific time periods applicable to a game of golf, such as the five-minute rule, to be measured objectively and simply with the specific advantage of being a non-disturbing yet readily usable piece of equipment which is required in general to be carried by all golfers. The repair tool timing device has operating buttons which are on the pitch-mark repair tool and which can be recessed and of such a size and shape that unintentional activation of the timing device is prevented when using the tool purely to repair a pitch-mark.

21 Claims, 3 Drawing Sheets

COMBINED PUTTING GREEN REPAIR TOOL AND STOPWATCH

FIELD OF THE INVENTION

The present invention relates to golf equipment and its use whilst playing golf and in particular to pitch-mark repairing equipment foreseen with means for indicating elapse of a specific time period.

BACKGROUND OF THE INVENTION

Because of the distraction to a golfer which can be caused by wearing a wristwatch due to either the reflection from the watch face or its movement on the wrist when playing a shot, most serious players never wear a watch. Even those that do wear one often find it difficult to use when clothed for cold or rainy weather.

One solution to overcome this difficulty is proposed in U.S. Pat. No. 4,766,611 (Kim, Aug. 30, 1988), whereby a watch is attached to a golf glove around the Velcro flap which is used to fasten the glove.

Such a solution as in Kim however, is far from ideal since about 30 percent of golfers do not wear a glove and, for those that do, the reflection which can be caused in the face of the watch can be particularly annoying when taking a stance to hit the ball or even more so when trying to putt the ball, when a great deal of players do not remove their glove. Moreover, the addition of the watch element to the glove, even when it is integral, produces a stiffening of the glove fastening flap which does not allow the fastening flap to adapt fully to the shape of the back of the hand, as would a normal golf glove, which causes a disturbance as the player is very much aware of the presence of the watch unit.

Another problem that has arisen in recent years is that golf courses are becoming ever more crowded as the popularity of the game increases. Hence to be able to get the maximum number of players on a golf course during one day, the avoidance of slow play is very important. A player who loses his ball after hitting it is allowed a maximum of five minutes to search for it, to give him a fair chance of locating it but without slowing down play unduly. To avoid slow play this rule must be strictly adhered to, although the disadvantages of wearing a wrist watch, or a golf glove with an attached or integral watch face, are evident from the above explanation. Additionally, to carry a watch in a golf bag is inconvenient since it may be difficult to easily locate or may not be readily at hand if one is not next to one's golf bag when assisting to search for a player's ball. Carrying it in a trouser or shirt pocket is also not ideal, especially as players already have a pitch-mark repairer, tees, pencil and maybe other implements in their pockets. Even those players who do have a watch are generally not in a position to easily and accurately identify when the five minute period started or when it should end.

Particularly in competitions, players determined not to admit that their ball is lost or unable to judge a five minute period often claim that they have only been searching for a shorter time and, as a result, often manage to extend the period by a substantial amount. Additionally, some players are worried about slowing play down unduly and do not allow themselves sufficient time to search. This may also happen when they rely on another member of their flight to judge the time period. Whilst the speed of play may hereby be increased, the effect on the player's score will not be fair and consequently the handicap may be incorrect. Moreover, bad judgement (either on the upper or lower side of the specific time period) often creates ill will and may be the subject and source of rumours and comments. If objectivity could be provided then fairer scores, faster play, correct handicaps and an end to this source of rumour could be provided. However, this must not be at the expense of comfort or convenience.

As part of playing the game of golf, players pitch their ball onto the green surrounding the hole. In landing on the green, the ball often causes damage known as a "pitch-mark". Since players must putt their ball into the hole on the green, it is required that such marks are repaired by the player involved. This is normally done using a well known tool called a pitch-mark repair tool, sometimes referred to as a green repair tool, a pitch-repairer or even a green-repairer. The implement will be referred to as a pitch-repairer hereafter. Many golf courses and national golf associations now require that each player has a pitch-repairer before starting play and many clubs keep a look out that players are repairing their pitch-marks appropriately. Pitch-repairers are well known and generally consist of two prongs and a holding portion and can either be of metal or plastics materials or a combination of these, the only requirement being that they are rigid enough to be able to withstand the bending and shear forces applied when repairing a pitch-mark.

SUMMARY OF THE INVENTION

Accordingly it is an object of the present invention to provide a means which allows non-interference to the golfer during hitting or putting the ball, which is always readily at hand, which does not require an extra item of equipment (additionally to what is already carried) and which can perform the required task of indicating elapse of a five minute period objectively and reliably.

To provide a solution to these objects the present invention, in one aspect, provides a pitch mark repair tool for repairing pitch marks made in golf greens, wherein said repair tool is foreseen with a timing device which, after actuation, can indicate elapse of a specific time period.

It is clear that whilst the specific time period would normally be a five-minute period, the rules of the game may change to specify another time period. Similarly, measurement may be required of another time period such as where a special time rule is adopted for other elements of play.

Whilst many embodiments are possible, the pitch-repairer will normally be foreseen with detectable signal means, being for example visible and/or audible means, which can indicate that time period elapse has occurred such that constant observation of the display panel is not necessary. Clearly both digital and analogue display panels could be used for indicating either a count-down or a count-up sequence, whichever is felt more appropriate. Additionally, means can be provided for switching between the count-down and count-up modes if both are provided.

To keep the timing device as simple as possible it could be imagined that only one operating button be provided having in sequential pressing operations the functions of start, stop and reset, although other functions for altering the display or mode of operation could be provided. The most practical embodiment would however normally be one where two operating buttons are used, one for start/stop, the other for mode selection. However, more than two could obviously be used, depending on the method of operation desired.

One particularly useful embodiment of the device would be where the operating buttons are recessed and of such a size and shape that only operation by narrow means such as the edge of a finger nail or the tip of a pen or pencil (which each golfer must have for noting his score) is possible. This provides the advantage that unintentional operation of timing device is normally prevented when the pitch-repairer is used for repairing a pitch-mark.

Whilst clearly not essential, it would normally be the case that the attachment of the timing device to, or the moulding of the timing device integrally as part of, the pitch-repairer, would be such that the timing device is rendered waterproof.

Whatever method of attachment is used, said pitch mark repair tool may be constructed so as to consist of two pieces, said first piece being constituted by said timing device arranged in a housing and said second piece being a body portion of said pitch mark repair tool. The second piece would have a recess therein for receiving said housing of said first piece in a manner which allows one piece to be detached from the other, but which allows an adequately secure connection when the two are attached such that they do not come apart in use. This detachable arrangement allows housings containing the timing device to be attached to the golf repair tool, such that for example housings of a different colour or pattern could be used with or without different timing devices. This particular embodiment allows not only the individual user to choose the insert housing type but provides a significant saving in production costs since the body portion of the pitch repairer can be kept the same for a series of inserted housings which may be for specific advertising purposes.

In designing the operating features of the timing device and the display panel it can also be useful if a type of tell-tale indication means is foreseen, such that if the timing sequence is interrupted after actuation, a mark will appear in the display panel. This is clearly of some importance since a player wishing to extend his allowed time period may stop and then restart the timing device, which without the tell-tale would otherwise be hard to detect. An example of such a tell-tale could be a dot in the display panel, although many other possibilities, such as a square or even a flashing display and/or sound alarm could be imagined. The tell-tale in the display panel would normally then disappear after say two or three minutes so as not to cause misunderstanding by the next operation of the device.

The invention also provides for the possibility whereby the pitch-repairer could be provided with a covering sheath adapted to it in order to provide a more attractive sale item on which logos or the like could be printed more easily, due to the larger available surface area. In such a case it is clear that either the sheath or the pitch-repairer could be the element foreseen with the timing device. Where the sheath contains the timing device the clear advantage would be that the pitch-repairer could be kept standard and only the sheath be adapted to have the timing device integral or attached thereto.

The invention also provides for a method of achieving more correct play in golf whereby, in the event of a suspected lost ball, a timing device on pitch mark repair equipment, is actuated such that after elapse of a specific time period, usually being five minutes, a detectable signal is emitted.

By the combination of a timing device and pitch-repairer as described, the inventor has been able to solve a multitude of problems in a simple and efficient manner and has thereby provided an implement which is readily adaptable for the printing of logos or attachment thereto of other advertising material.

DESCRIPTION OF PREFERRED EMBODIMENTS

Figure 1:
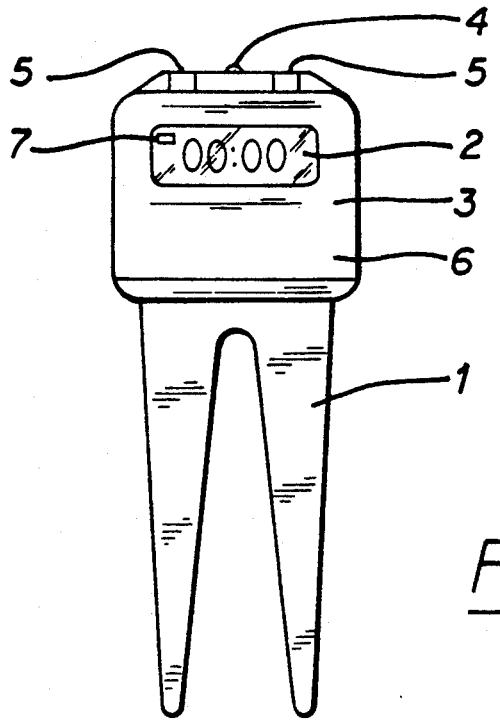
FIG. 1 shows a front view of a first embodiment of a pitch-repairer according to the invention.
Figure 2:
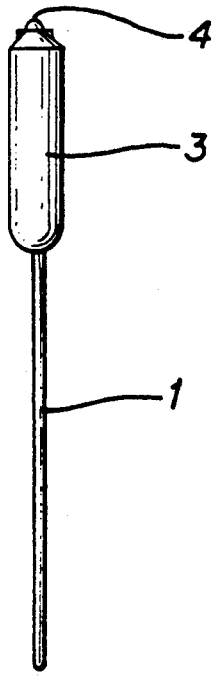
FIG. 2 shows a side view of the pitch-repairer of FIG. 1.

FIGS. 1 and 2 show a pitch-repairer according to the invention, which consists of two basic elements, a body portion 1 and a timing device portion 2. The pitch-repairer body portion 1 is here depicted in its well known basic shape, however other designs are clearly imaginable. In this embodiment the timing device 2 is fixed in a housing 3 and this in turn is fixed to the body portion 1. The exact method of fastening of the two basic elements together is of no particular importance and may be of any suitable type which affords adequate stiffness to serve as a pitch-repairer. The body portion 1 could of course be constructed in one-piece with the housing 3 if desired.

The timing device 2 is foreseen with two operating elements 5 at the end of the pitch-repairer remote from the two prongs of the body portion. These operating elements 5 will preferably be recessed with respect to the housing outer surface in order that unintentional operation of the device may be prevented.

The pitch-repairer and timing device will normally have a display of time after actuation. For this purpose, in this embodiment, the pitch-repairer timing device 2 has a digital display. A digital and electronic construction is preferable for most applications since the digital control and display elements are readily available, are fairly cheap, very robust, water-resistant (if not waterproof) and can generally withstand shock loads for example. However, an analogue display could be used if this is preferred for example to offer a better quality appearance to the golfer. Various types of display unit may be envisaged for the invention, but one preferred type as shown is where a so-called tell-tale 7 is included as one of the display possibilities. With such a tell-tale 7, an indication is provided that the operating sequence has been interrupted. Thus, the tell-tale may flash, light up, or even move around the display for example. As an additional indication an audible signal might be issued, so that the user and his opponents are aware that the sequence has been interrupted. The operating elements 5 are used to control the timing mode and start/stop and reset facilities. In its most simplest form, only the five-minute period might be possible to actuate such that only start/stop and reset facilities need be provided, which could if desired simply be arranged with only one operating element. Where further specific time periods are to be shown more buttons may be required to allow easier use. The actual form of the display is shown here to be "00:00", but clearly other display types could be used.

The means of indicating the elapse of the specific time period, after actuation of the timing device via one of the elements 5, can vary. In the Figures an indication means being a light 4 is depicted, but clearly audible means are possible and may even be desirable since observation of the timing device display after actuation is then not necessary.

Figure 6:
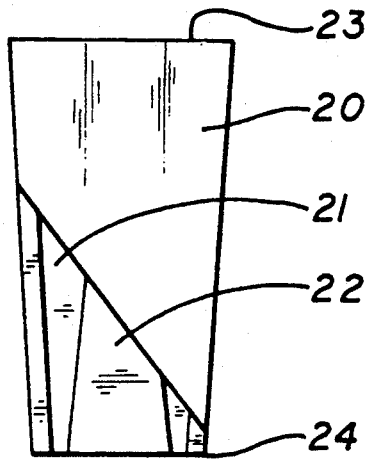
FIG. 6 shows a covering sheath specially adapted for the pitch-repairer according to the first embodiment, wherein the lower part of the front face of the sheath has been removed to show internal detail.

A logo or other printed matter 6 can be placed or printed on any convenient surface of the repairer. In this embodiment it is shown on the same side as the display panel but clearly nothing normally prevents printing on the opposite side. If a sheath is provided as shown in FIG. 6, this may provide the surface for printing or attachment of advertising or other decorative material.

Figure 3:
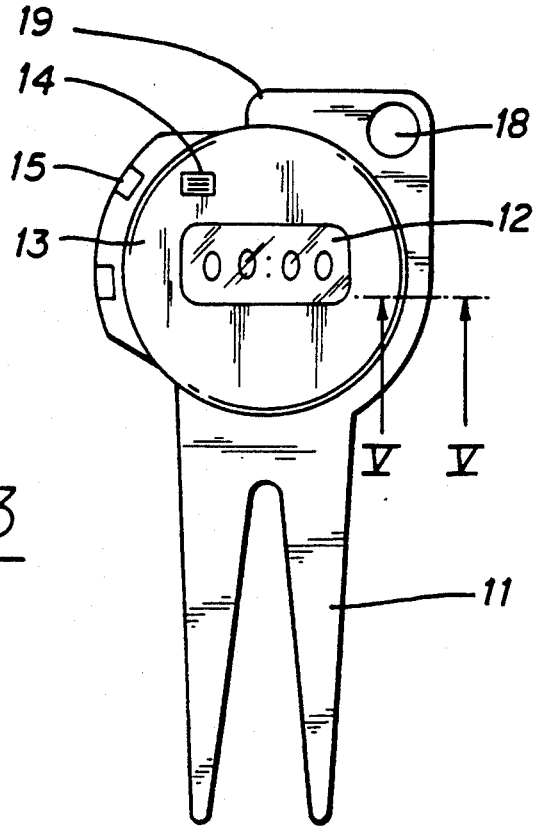
FIG. 3 shows a front view of a second embodiment of a pitch-repairer in accordance with the invention.
Figure 4:
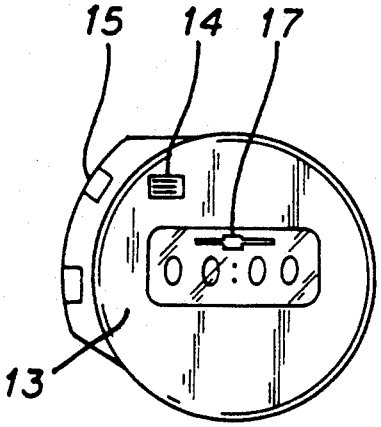
FIG. 4 shows the timer and housing unit of the pitch-repairer of FIG. 3 which is detached from the body portion of the pitch-repairer.
Figure 5:
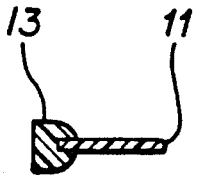
FIG. 5 shows a sectional view taken along the line V—V in FIG. 3.

FIGS. 3 to 5 show a second embodiment of the invention in which the pitch-repairer comprises two parts, a body portion 11 and a housing 13 with a timing device 12. The two parts are push-fitted together in this embodiment so as to be securely attached for use but still detachable if required. In this manner, different housings 13 may be attached for the desired purpose. For example differently decorated housings can easily be fitted. The operating buttons 15 would generally be recessed such that they could only be operated by narrow means such as the edge of a finger nail or the tip of a pencil or pen. Since golfers almost always carry a pencil or pen (in order to mark their scores) the recesses for the operating buttons 15 may be made so small to only allow actuation by a pointed instrument such as a pencil or pen tip. In FIG. 3 the upper part 19 of the body portion 11 supports the housing in a detachable yet secure manner, such that the housing will not fall out during use. The method of attachment used here will be explained with reference to FIG. 5 below. The housing 13 has a miniature loudspeaker 14 built into it, which is able to emit an audible signal for indicating elapse of the specific time period. A hole 18 is foreseen in the upper part 19 of the body portion, said hole serving as an attachment means for example to a key ring or some type of ring attachment means on a golf bag.

FIG. 4 shows the detachable housing 13 with timer removed from the pitch-repairer. The reference 17 denotes a tell-tale which has appeared in the display as a result of the specific period of time having been interrupted. As stated previously though, the type of tell-tale means can vary.

FIG. 5 is a sectional view along line V—V in FIG. 3. One means of connecting the two elements is shown, wherein the housing 13 is provided with a groove which is an interference push-fit with the body portion 11 of the pitch repairer.

FIG. 6 depicts a sheath 20 for protecting the pitch repairer from being scratched or otherwise damaged. The lower part of the front cover has been removed to show internal detail wherein the grooves 21 in which the prongs of the pitch-repairer fit are divided by an intermediate portion 22. As is evident, the pitch-repairer will be inserted into the sheath through the open top 23 of the sheath and will normally be held tightly therein by an interference fit somewhere between the sheath and the pitch-repairer. The corners of the sheath may be rounded as shown at 24 so as not to cause damage to a player's pocket which may otherwise occur.

Figure 7:
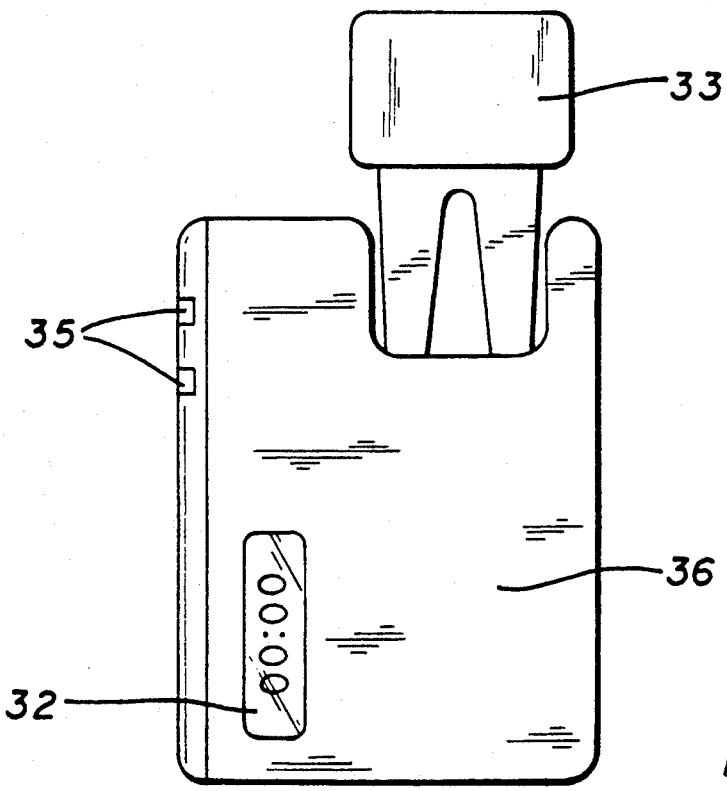
FIG. 7 shows pitch mark repair equipment consisting of a pitch-repairer and a sheath adapted therefore in a position where the pitch-repairer has been partly withdrawn from the sheath, wherein the sheath is foreseen with a timing device.

The combination of pitch-repairer and sheath shown in FIG. 7 is in accordance with another aspect of the present invention, whereby the timing device 32 and actuation elements 35 are connected to the sheath and the pitch-repairer 33 is of standard type, with or without a logo. Such a combination and arrangement may be desirable if a larger logo 36 or other indication is needed.

METHOD OF OPERATION

The method of using the pitch-repairer for its main purpose of repairing pitch marks remains unaltered. Should a player however wish to use the timing device for timing a search for a lost ball for example, he merely needs to press the operating button designated to actuate start of the specific and preset time period in the timing device. Upon actuation, the user would then normally inform the other players that the specific time period has started. When the specific time period has elapsed a detectable signal will be emitted, such as a sound tone for example. If the time period is five minutes, as it would be normally for a lost ball, then all players are clearly aware that the period has expired and that the ball must be declared lost. Should intentional or unintentional interruption of the time period occur, then a tell-tale sign will appear either in the visibly or audibly or both. In this way incorrect use can be prevented. Should it be desired, other modes of operation, in addition to the specific time period, may be foreseen, such as a continuous count of length of playing time or further specific time periods such as a ten-minute period.

Although certain embodiments have been described, it is clear that the invention may be varied arbitrarily within the scope of the appended claims. For example, to take account of playing in dark conditions, a light might be installed for illuminating the display panel and although only one type of pitch-repairer has been described and depicted it is clear that many variations on the two-prong type are possible, such as pitch-repairers with three prongs or those shaped with additional elements for opening crown-top bottles, for screwing in studs or even for cleaning clubs, to name but a few. The materials could also be varied greatly but would normally be either metal or plastics or a combination of both. It is thus intended that such changes are included within the scope of the appended claims.

What is claimed is:

1. A golf pitch mark repairer comprising, in combination:

a pitch mark repairer for repairing dents and divots in a golf green; and a timing device consisting of a stopwatch, attached to the pitch mark repairer, for counting off and indicating the elapse of a pre-determined waiting period during which a player is permitted to look for a lost golf ball.

2. A golf pitch mark repairer as defined in claim 1, further including an indicator for signalling the end of the waiting period.

3. A golf pitch mark repairer as defined in claim 2, in which the indicator is a light that is attached to the stopwatch.

4. A golf pitch mark repairer as defined in claim 1, in which the stopwatch operates in a count-down mode for counting down the elapsed time of the waiting period.

5. A golf pitch mark repairer as defined in claim 1, in which the stopwatch is provided with adjustment means for setting the duration of the pre-determined waiting period.

6. A golf pitch mark repairer as defined in claim 1, in which the stopwatch is provided with a first operating element for actuating the stopwatch to begin counting off the waiting period and a second operating element for resetting the stopwatch.

7. A golf pitch mark repairer as defined in claim 1, in which the stopwatch includes tell-tale means for indicating interruption of the stopwatch when it is counting off the waiting period.

8. A golf pitch mark repairer as defined in claim 7, in which the stopwatch includes a elapsed-time display, and in which the tell-tale means is a display element that is visible when the stopwatch has been interrupted.

9. A golf pitch mark repairer as defined in claim 1, in which the stopwatch includes a digital elapsed-time display.

10. A golf pitch mark repairer as defined in claim 1, in which the pitch mark repairer has a two-prong body.

11. A pitch mark repair tool according to claim 1, wherein said pitch mark repair tool consists of two pieces, a first piece being constituted by said timing device arranged in a housing and a second piece being a body portion of said pitch mark repair tool, said second piece having a recess therein for detachably receiving said housing of said first piece.

12. A golf pitch mark repairer consisting of:

a pitch mark repairer for repairing dents and divots in a golf green; and a stopwatch, attached to the pitch mark repairer, for counting off and indicating the elapse of a pre-determined waiting period during which a player is permitted to look for a lost golf ball.

13. A golf pitch mark repairer as defined in claim 12, in which the stopwatch includes an indicator for signalling the end of the waiting period.

14. A golf pitch mark repairer as defined in claim 13, in which the indicator is a light.

15. A golf pitch mark repairer as defined in claim 12, in which the stopwatch operates in a count-down mode for counting down the elapsed time of the waiting period.

16. A golf pitch mark repairer as defined in claim 12, in which the stopwatch is provided with adjustment means for setting the duration of the pre-determined waiting period.

17. A golf pitch mark repairer as defined in claim 12, in which the stopwatch is provided with a first operating element for actuating the stopwatch to begin counting off the waiting period and a second operating element for resetting the stopwatch.

18. A golf pitch mark repairer as defined in claim 12, in which the stopwatch includes tell-tale means for indicating interruption of the stopwatch when it is counting off the waiting period.

19. A golf pitch mark repairer as defined in claim 18, in which the stopwatch includes an elapsed-time display, and in which the tell-tale means is a display element that is visible when the stopwatch has been interrupted.

20. A golf pitch mark repairer as defined in claim 12, in which the stopwatch includes a digital elapsed-time display.

21. A golf pitch mark repairer comprising, in combination:

A. a pitch mark repairer, comprising a two-prong body, for repairing dents and divots in a golf green;

B. a timing device consisting of a stopwatch, attached to the pitch mark repairer, for counting off and indicating the elapse of a pre-determined waiting period during which a player is permitted to look for a lost golf ball; in which the stopwatch includes:

1) a light for signalling the end of the waiting period;

2) adjustment means for setting the duration of the pre-determined waiting period;

3) a first operating element for actuating the stopwatch to begin counting off the waiting period;

4) a second operating element for resetting the stopwatch;

5) a digital elapsed-time display; and 6) tell-tale means for indicating interruption of the stopwatch when it is counting off the waiting period, comprising a display element on the elapsed-time display that is visible when the stopwatch has been interrupted.

* * * * *